US007355558B2

(12) United States Patent
Lee

(10) Patent No.: US 7,355,558 B2
(45) Date of Patent: Apr. 8, 2008

(54) CHIP ANTENNA

(75) Inventor: Jae Chan Lee, Kyungki-do (KR)

(73) Assignee: Samsung Electro-Mechanics Co. Ltd., Suwon, Kyungki-Do (KR)

( * ) Notice: Subject to any disclaimer, the term of this patent is extended or adjusted under 35 U.S.C. 154(b) by 88 days.

(21) Appl. No.: 11/320,197

(22) Filed: Dec. 28, 2005

(65) Prior Publication Data

US 2006/0145928 A1 Jul. 6, 2006

(30) Foreign Application Priority Data

Jan. 3, 2005 (KR) ..... 10-2005-0000267

(51) Int. Cl.

| | |
|---|---|
| ***H01Q 1/36*** | (2006.01) |
| ***H01Q 1/24*** | (2006.01) |
| ***H01Q 1/38*** | (2006.01) |
| ***H01Q 5/00*** | (2006.01) |
| ***H01Q 9/04*** | (2006.01) |

(52) U.S. Cl. ..... 343/895; 343/702; 343/700 MS

(58) Field of Classification Search ..... 343/702, 343/700 MS, 895

See application file for complete search history.

(56) References Cited

U.S. PATENT DOCUMENTS 6,618,023 B2 9/2003 Park
6,819,289 B2 * 11/2004 Kim et al. ..... 343/700 MS
2003/0001793 A1 * 1/2003 Park ..... 343/895

FOREIGN PATENT DOCUMENTS

KR 423395 B 3/2004

* cited by examiner

*Primary Examiner*—Hoang V. Nguyen
*Assistant Examiner*—Robert Karacsony
(74) *Attorney, Agent, or Firm*—Volpe and Koenig P.C.

(57) ABSTRACT

The present invention relates to a chip antenna including first and second conductor patterns formed on upper and lower surfaces of a dielectric block in a width direction of the dielectric block. The chip antenna also includes conductive vertical-connecting parts formed in a vertical direction of the dielectric block to connect the first conductor patterns with the second conductor patterns to form a radiation line. The first and second conductor patterns comprise pairs of L-shaped and symmetrical L-shaped conductor patterns having bent parts overlapped in part with each other in a width direction and extended in a longitudinal direction of the dielectric block. Also, horizontal-connecting conductor patterns are formed in a width direction of the dielectric block.

12 Claims, 8 Drawing Sheets

(a)

(b)

CHIP ANTENNA

CLAIM OF PRIORITY

This application claims the benefit of Korean Patent Application No. 2005-0000267 filed on Jan. 3, 2005, in the Korean Intellectual Property Office, the disclosure of which is incorporated herein by reference.

BACKGROUND OF THE INVENTION

1. Field of the Invention

The present invention relates to a chip antenna, and more particularly, to a chip antenna having a new mono-pole structure which enables achievement of low and broadband resonance frequency without increasing volume.

2. Description of the Related Art

In general, miniaturization in mobile telecommunication terminals has brought necessity of miniaturization of chip antennas as well. The miniaturized chip antenna is manufactured by using a single dielectric block or depositing plural dielectric sheets to form a dielectric block and then forming conductor patterns constituting radiation element on the dielectric block.

A chip antenna installed in a Bluetooth or a Wireless Local Area Network (WLAN) mobile telecommunication terminal requires relatively low frequency band, and thus has longer conductor patterns constituting a radiation element to obtain a sufficient length of electric resonance, which makes the chip antenna more difficult to be miniaturized.

In order to solve such a problem, Korean Patent Publication No. 423395 (assigned to Samsung Electro-Mechanics, published on Mar. 5, 2004) discloses miniaturization of a chip antenna which uses conductive patterns having bent parts. As shown in FIG. 1, the chip antenna according to the above literature includes a rectangular parallelepiped dielectric block 11 having upper and lower surfaces. And conductor patterns 12*a* and 12*b* are bent in a regular shape and formed on upper and lower surfaces of the dielectric block 11. In addition, the conductor patterns 12*a* and 12*b* are connected with side conductor patterns 15 to form a single radiation line wound in a spiral.

Such conductor pattern structure has an advantage in that it is integrated on a surface of a dielectric block of a small volume, allowing obtainment of sufficient length of electric resonance. Therefore, the chip antenna can be further miniaturized from the existing one designed to achieve the same desired resonance frequency.

However, mobile telecommunication terminals are further miniaturized recently and thus a chip antenna with even lower resonance frequency in a same volume is required. Using a dielectric block of 3×2×1.2 (mm), the chip antenna disclosed in the above document is able to manufacture a sufficiently long radiation line to achieve a resonance frequency of the Bluetooth band (3.55 GHz) but is not able to achieve a resonance frequency of the WLAN band (2.45 GHz). In order to achieve even lower frequency, large size of the chip antennas is inevitable.

In the meantime, it is desirable for the chip antenna to achieve resonance frequency band as wide as possible to maintain sending and receiving capabilities in the changing external conditions, but there is a limitation as to maintaining a miniaturized structure and achieving wide resonance frequency band as desired at the same time.

SUMMARY OF THE INVENTION

The present invention has been made to solve the foregoing problems of the prior art and it is therefore an object of the present invention to provide a chip antenna having a radiation structure in a length sufficient for lower resonance frequency without increasing volume.

It is another object of the invention to provide a chip antenna capable of achieving broadband of the desired resonance frequency without being increased in size.

According to an aspect of the invention for realizing the object, there is provided a chip antenna including: a dielectric block having a rectangular parallelepiped structure; a plurality of first and second conductor patterns formed on upper and lower surfaces of the dielectric block, respectively, in a width direction of the dielectric block; and a plurality of conductive vertical connecting parts formed in a vertical direction of the dielectric block to connect the first conductor patterns with the second conductor patterns so that the first and second conductor patterns form a radiation line, and wherein each of the first and second conductor patterns comprises at least one pair of L-shaped conductor pattern and symmetrical L-shaped conductor pattern each having a bent part bent and extended in a longitudinal direction of the dielectric block, the bent parts overlapped in part with each other in a width direction, and at least one horizontal-connecting conductor patterns formed in a width direction.

Preferably, each of the first and second conductor patterns comprises the pair of L-shaped and symmetrical L-shaped conductor patterns, and the L-shaped and symmetrical L-shaped conductor patterns alternate with the horizontal-connecting conductor pattern on upper and lower surfaces of the dielectric block to provide a single radiation line.

Preferably, the bent parts of the L-shaped and symmetrical L-shaped conductor patterns are angled at 90 degrees from the L-shaped and symmetrical L-shaped conductor patterns, respectively. The conductive vertical-connecting parts may be formed along side surfaces of the dielectric block or may be a conductive via pierced through upper and lower surfaces of the dielectric block.

In addition, to facilitate the designing of the antenna, the first and second conductor patterns are may be formed in an equal with.

Preferably, the length of the overlapped parts of the pair of L-shaped and symmetrical L-shaped conductor patterns is at least the width of the horizontal-connecting conductor patterns, and shorter than the length of extension of the bent parts.

According to a preferred embodiment of the present invention, a dielectric layer may further be provided on upper or lower surface of the dielectric block, having a plurality of third conductor patterns formed on upper or lower surfaces thereof and a plurality of conductive vertical-connecting sections each connecting each of the first and second conductor patterns of the dielectric block with each end of the third conductor patterns.

Preferably, the dielectric layer has a size of area corresponding to the size of the upper or lower surface of the dielectric block.

The plurality of third conductor patterns may be disposed in a width direction of the dielectric layer, and at least one of the vertical-connecting parts may be connected integrally with a corresponding one of the vertical-connecting parts of the dielectric block.

According to another embodiment of the present invention, there is provided a chip antenna including: a dielectric block having a rectangular parallelepiped structure; a plurality of first and second conductor patterns formed on upper and lower surfaces of the dielectric block, respectively, in a width direction of the dielectric block; a plurality of first conductive vertical-connecting parts formed in a vertical direction of the dielectric block to connect the first conductor patterns with the second conductor patterns so that the first and second conductor patterns form a radiation line; and a dielectric layer formed on the upper or lower surface of the dielectric block, comprising a plurality of third conductor patterns formed on the upper and lower surface thereof and a plurality of second conductive vertical-connecting parts each connecting each of the first and second conductor patterns of the dielectric block with each end of the third conductor patterns.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

Figure 2:
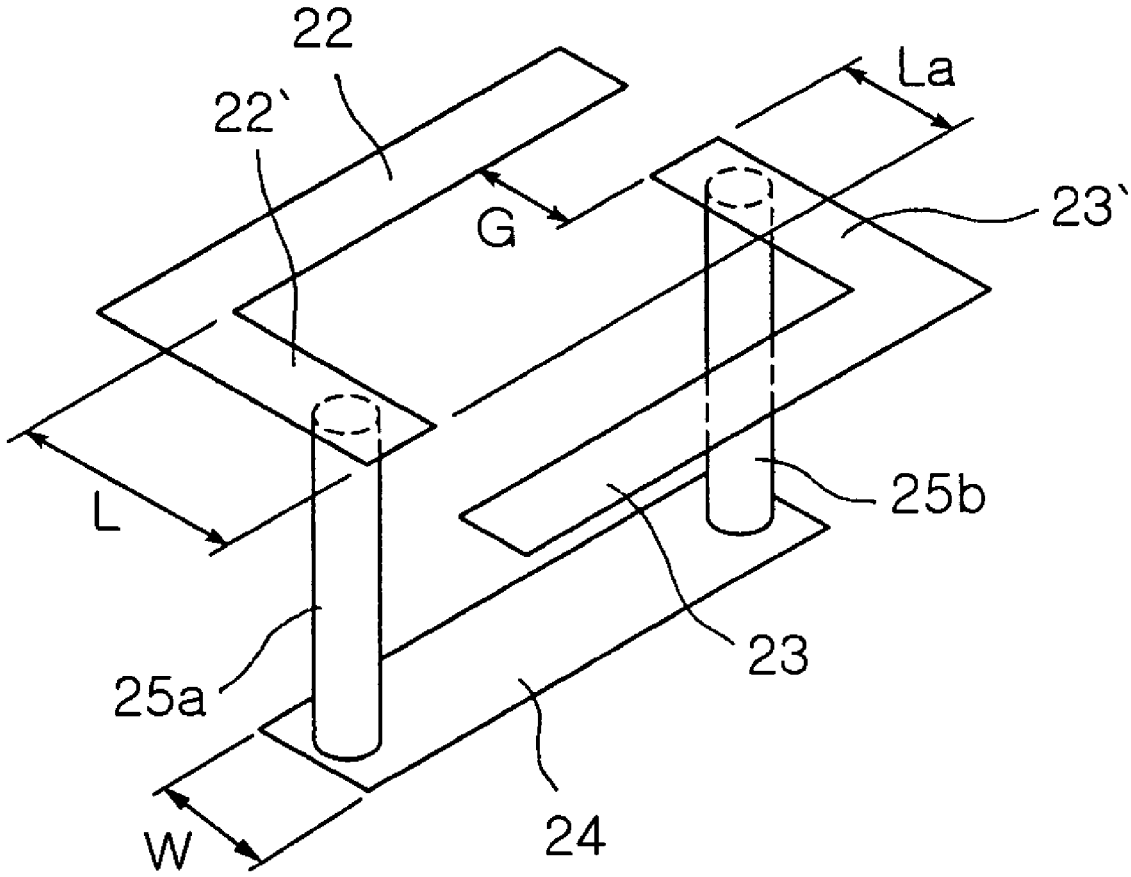
FIG. 2 is a perspective view illustrating a conductive pattern structure that can be adopted in the embodiment of the present invention.

FIG. 2 is a perspective view illustrating conductor pattern structure adoptable in an embodiment of the present invention. The conductor pattern structure in FIG. 2 is an example for explaining the integration method of the present invention, and such a structure allows increased resonance length than in a dielectric block of the same volume.

With reference to FIG. 2, a pair of L-shaped conductor pattern 22 and symmetrical L-shaped conductor pattern 23 is disposed on an upper part of the dielectric block and a vertical-connecting conductive pattern 24 is disposed on a lower part of the dielectric block. The L-shaped conductor pattern 22 and the symmetrical L-shaped conductor pattern 23 are bent to face each other, having bent parts 22' and 23' extended in a predetermined length L. The bent parts 22' and 23' are disposed to overlap each other in part for a predetermined length La. Preferably, the bent parts 22' and 23' may be angled at 90 degrees. That is, as shown in FIG. 2, the L-shaped conductor pattern 22 and the symmetrical L-shaped conductor pattern 23 face each other to form substantially a square, but are spaced apart in a predetermined interval G. Therefore, in case of the bent parts angled at 90 degrees, the length La of the overlapped part of the bent parts 22' and 23' are always shorter than the total length L of the bent parts 22' and 23'.

The horizontal-connecting conductor pattern 24 is positioned in a lower part region corresponding to the overlapped portions of the bent parts 22' and 23' of at least one pair of L-shaped and symmetrical L-shaped conductor patterns. In this case, two conductive vias 25*a* and 25*b* connect the end portions of the bent parts 22' and 23' of the pair of L-shaped and symmetrical L-shaped conductor patterns 22 and 23 with both end portions of the horizontal-connecting conductor pattern 24. Thereby, the pair of L-shaped and symmetrical L-shaped conductor patterns 22 and 23 can provide a single radiation line. Here, the conductive vias 25*a* and 25*b* are provided as conductive means for vertical connection, and may be provided as side conductor patterns formed on side surfaces of a dielectric block in another embodiment.

Preferably, the L-shaped and symmetrical L-shaped conductor patterns 22 and 23 may be disposed such that the length La of the overlapped portions of the bent parts 22' and 23' of the L-shaped and symmetrical L-shaped conductor patterns 22 and 23 is equal to or greater than the width of the horizontal-connecting conductor pattern 24. This allows the conductive vias 22 and 23 connected to the end portions of the bent parts 22' and 23' to be effectively connected with the horizontal-connecting conductor pattern 24.

The radiation line having the above conductor pattern structure can be more effectively integrated in the same volume, and can have increased electric resonance, compared with the conventional one.

The present invention includes a chip antenna having at least one of the conductor pattern structure illustrated in FIG. 2, but it is preferable that all conductor patterns are formed in such a structure of FIG. 2 in order to maximize the integration effect.

Figure 3:
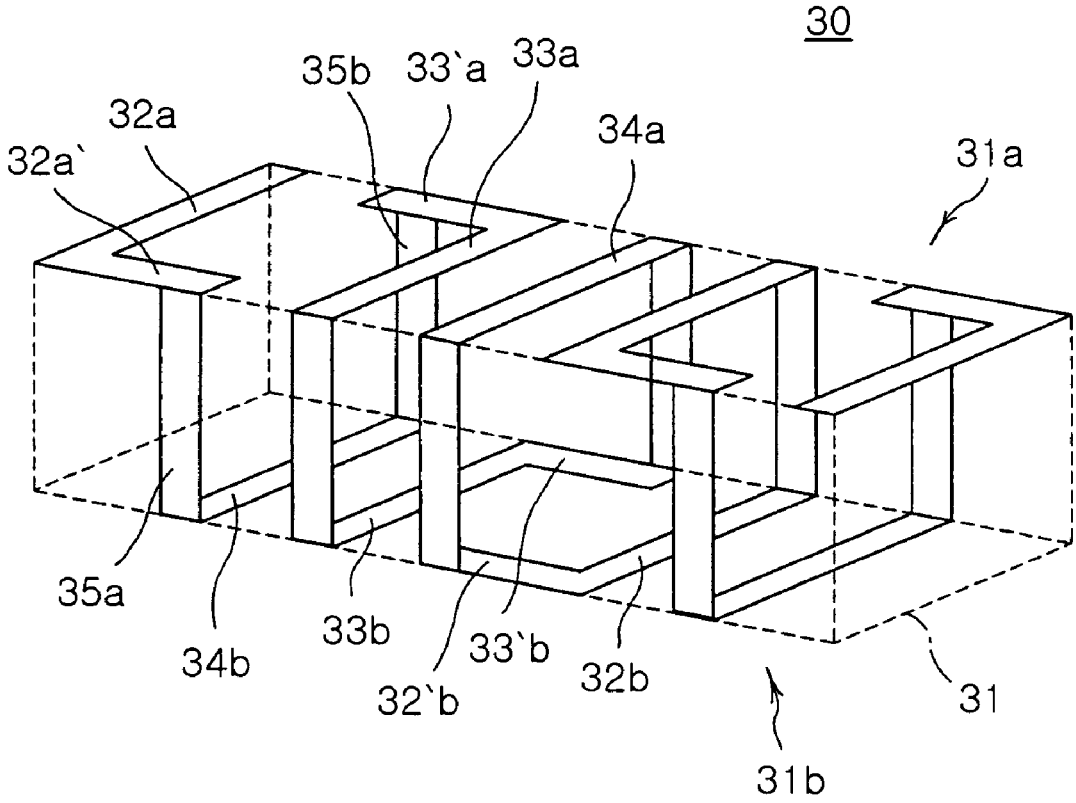
FIG. 3 is a perspective view illustrating a chip antenna according to an embodiment of the present invention.

FIG. 3 is a perspective view illustrating the chip antenna according to the embodiment with the above structure.

As shown in FIG. 3, the chip antenna 30 according to this embodiment includes a dielectric block 31 in a rectangular parallelepiped structure, having a plurality of conductor patterns 32*a*, 32*b*, 33*a*, 33*b*, 34*a*, 34*b*, 35*a*, 35*b* each formed in a width direction on upper and lower surfaces 31*a*, 31*b* and side surfaces thereof. Some of the conductor patterns formed on upper and lower surfaces 31*a* and 31*b* of the dielectric block are L-shaped and symmetrical L-shaped conductor patterns 32*a*, 33*a*, 32*b*, 33*b* which face each other in pairs, having bent parts 32*a*', 33*a*', 32*b*', 33*b*' bent in a width direction of the dielectric block 31. Others are horizontal-connecting conductor patterns 34*a* and 34*b* formed in a width direction. A pair of L-shaped and symmetrical L-shaped conductor patterns 32*a*, 33*a* and 32*b*, 33*b* alternate with horizontal-connecting patterns 34*a* and 34*b*. The pair of L-shaped and symmetrical L-shaped conductor patterns is opposed to the horizontal-connecting conductor pattern 34*b* or 34*a*, each of which is connected to the pair by each side conductor pattern 35*a* or 35*b*, providing a single radiation line. In addition, as described above, the bent parts 32*a*', 33*a*', 32*b*', 33*b*' are disposed to overlap each other partially in a width direction. Preferably, the bent parts 32*a*', 33*a*', 32*b*', 33*b*' may be angled at 90 degrees.

The present embodiment applied with the conductor pattern structure of FIG. 2 allows a formation of a conductor pattern having resonance length increased from the conventional chip antenna, achieving even lower resonance frequency in the same volume.

In the present embodiment, a single dielectric block was illustrated, but there may be provided a dielectric block structure composed of a plurality of dielectric sheets deposited on one another, in which case the side conductor patterns may take a form of conductive vias, an alternative form of vertical-connecting means.

Figure 4:
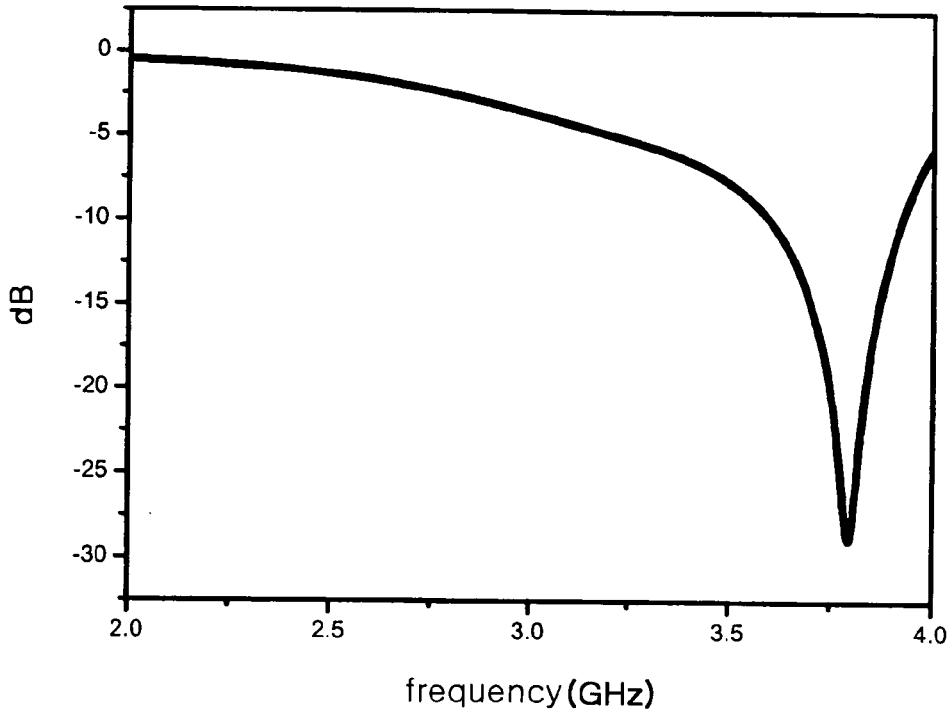
FIGS. 4*a* and 4*b* are graphs illustrating resonance frequencies of the conventional chip antenna and the chip antenna of the present invention.
Figure 4:
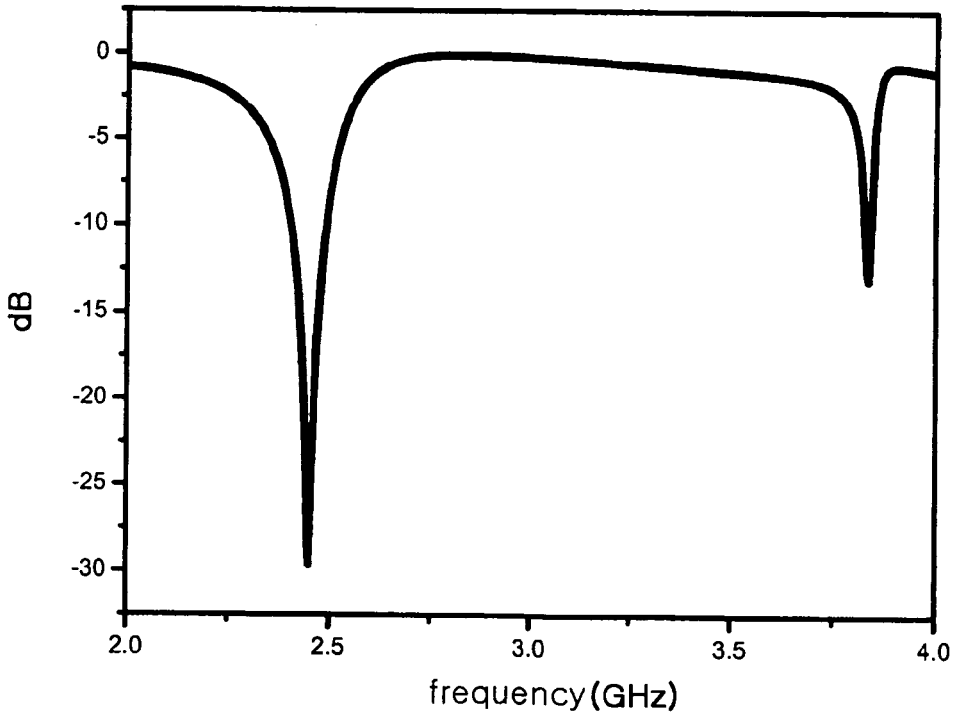

FIGS. 4*a* and 4*b* are graphs showing the resonance frequencies of a conventional chip antenna and a chip antenna of the present invention. Here, the conventional chip antenna (refer to FIG. 1) and the chip antenna of the present invention (refer to FIG. 3) use a dielectric block of the same size (3 mm×2 mm×1.2 mm) with conductor patterns of the same width (0.1 mm).

With reference to FIGS. 4*a* and 4*b*, the conventional chip antenna exhibits the resonance frequency of about 3.55 GHz, whereas the chip antenna of the present invention exhibits the resonance frequency of about 2.45 GHz. Therefore, according to the present invention, a sufficient length of conductor patterns is obtained, allowing low resonance frequency of about at least 1 GHz in a same volume of chip antenna.

Figure 5:
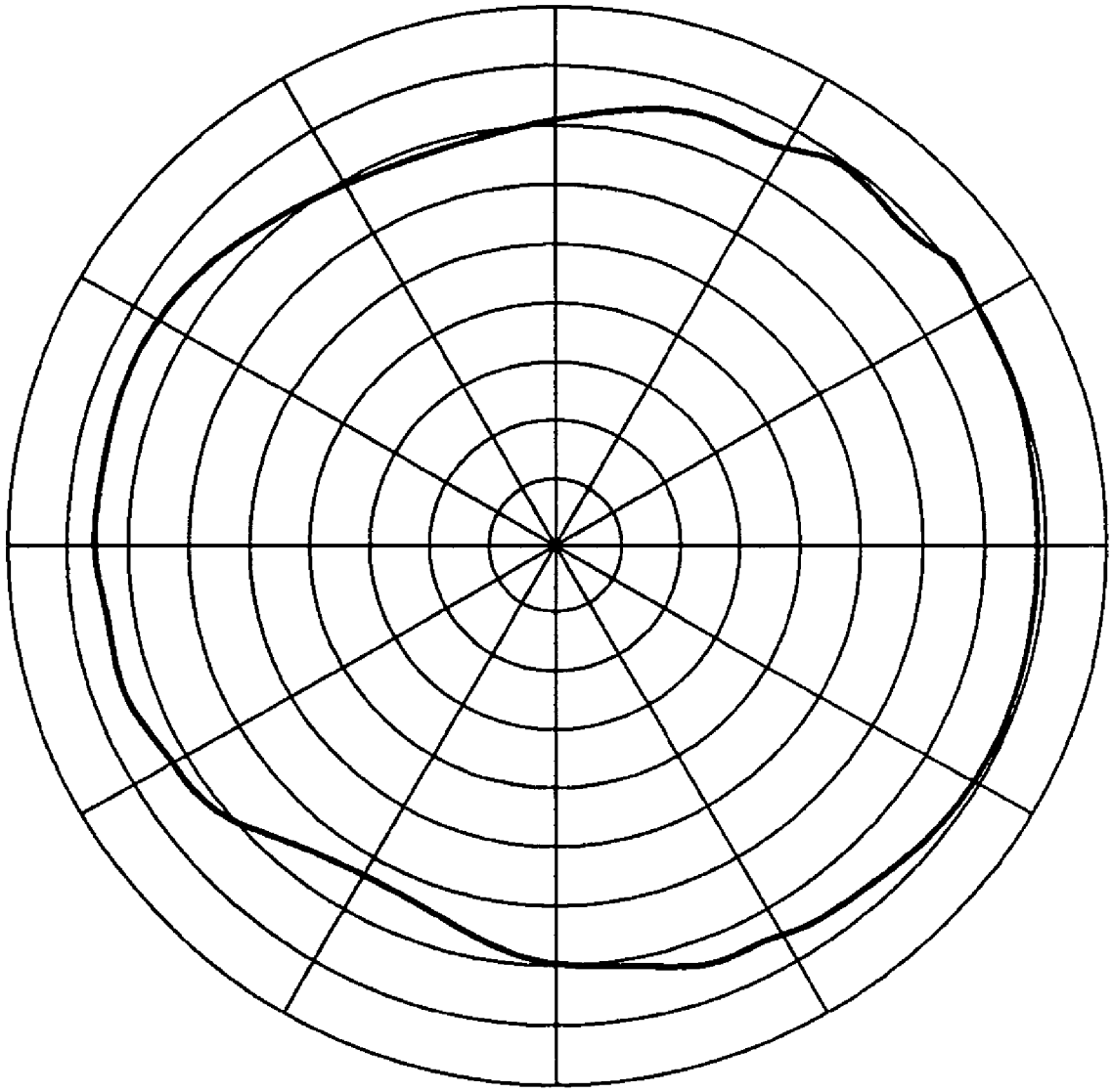
FIG. 5 is a graph illustrating radiation pattern in main radiation direction according to the present invention.

In addition, as shown in the graph of FIG. 5, it is confirmed that the radiation pattern of the present invention is omnipresent in all directions.

Figure 6:
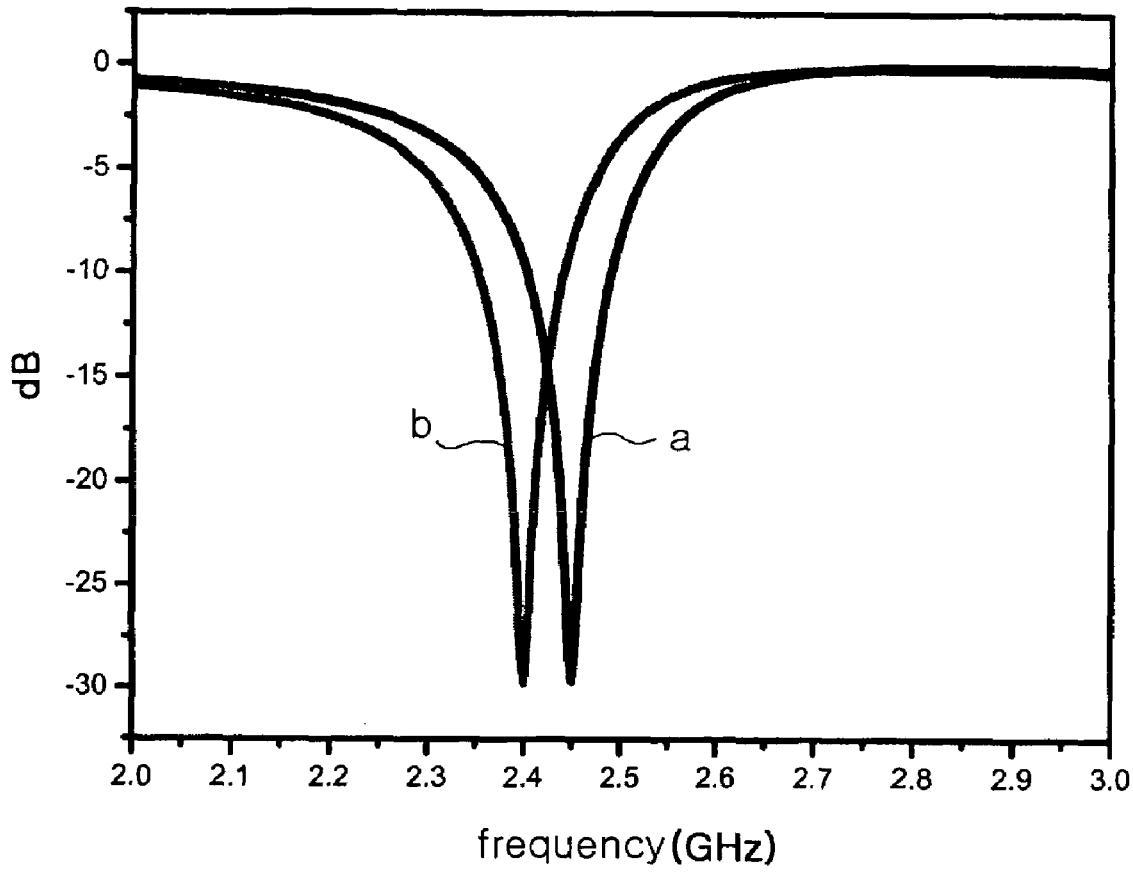
FIG. 6 is a graph illustrating an adjustment effect of the resonance frequency of the chip antenna according to the embodiment of the present invention.

In the chip antenna according to the present invention, the interval between the L-shaped conductor pattern and the symmetrical L-shaped conductor pattern can be adjusted to adjust the resonance frequency. For example, the interval is changed from 0.5 mm to 0.3 mm, and thereby, the length of the bent parts is changed from 0.4 mm to 0.2 mm. Then, the resonance frequencies before and after the changes were measured and the results are shown in FIG. 6. As shown in the graph in FIG. 6, the resonance frequency is changed from a to b as the interval is reduced between the conductor patterns, enabling tuning of about 0.05 GHz.

Figure 7:
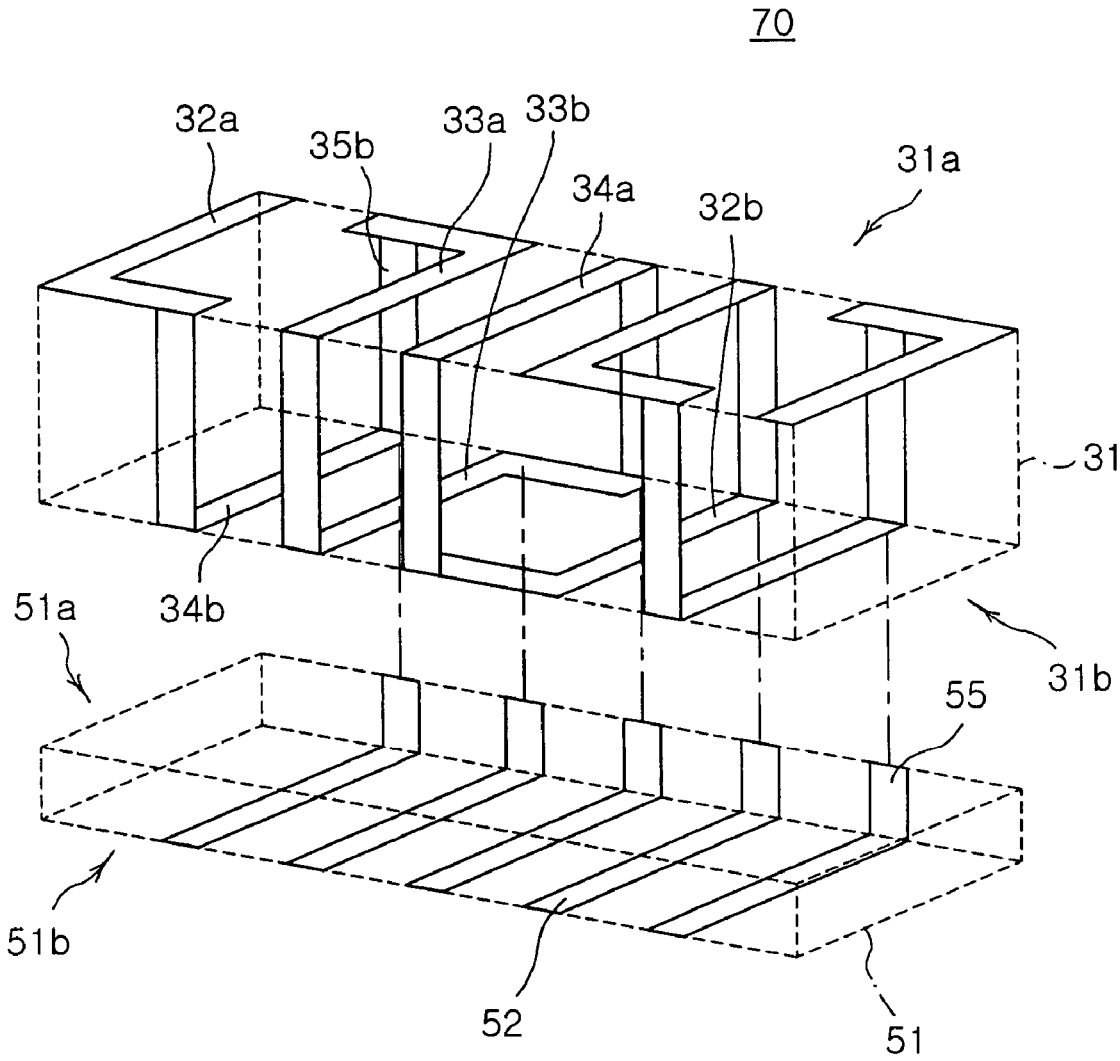
FIG. 7 is an exploded perspective view illustrating the chip antenna according to another embodiment of the present invention.

FIG. 7 is an exploded perspective view illustrating a chip antenna according to another embodiment of the present invention.

As shown in FIG. 7, the chip antenna 70 according to this embodiment has a structure in which a dielectric layer 51 having multi-resonance conductor patterns 52 thereon is integrally provided on the lower surface of the chip antenna 30 shown in FIG. 3. In addition, it is preferable that the dielectric layer 51 is provided in the same size as the area of the lower surface of the dielectric block 31 for miniaturization of the antenna.

On the lower surface 51*b* of the dielectric layer 51, five multi-resonance conductor patterns 52 are formed in a width direction. Each of the multi-resonance conductor pattern 52 has one end connected to each of the side conductor pattern 55 formed on a side surface of the dielectric layer 51. The side conductor patterns 55 of the dielectric layer 51 may be connected to the corresponding side conductor patterns 35*b* formed on a side surface of the dielectric block 31 or conductor patterns 33*b* formed on the lower surface 31*b* of the dielectric block 31.

The plurality of conductor patterns 32*a*, 33*a*, 32*b*, 33*b*, 34*a*, 34*b*, 35*a*, 35*b* formed on upper and lower surfaces and side surfaces of the dielectric block in a width direction are connected with each other to provide a single radiation line. But the conductor patterns 35*b* and 33*b* are connected to the multi-resonance conductor patterns 52 of the dielectric layer 51, providing additional plurality of different electric resonance lengths, respectively, and thereby the multi-resonance conductor patterns 52 generate resonance frequencies different from the resonance frequency of the radiation line.

As such, the multi-resonance conductor pattern 52 adopted in the present invention connects one end of the additional plurality of conductor lines with the existing radiation line, forming additional current path, thereby forming dual bands or widening each resonance frequency band.

In this embodiment, additional dielectric layer was provided on the lower surface of the dielectric block, but a dielectric layer with multi-resonance conductor patterns thereon may be provided on the upper surface of the dielectric block in a similar manner.

Figure 8:
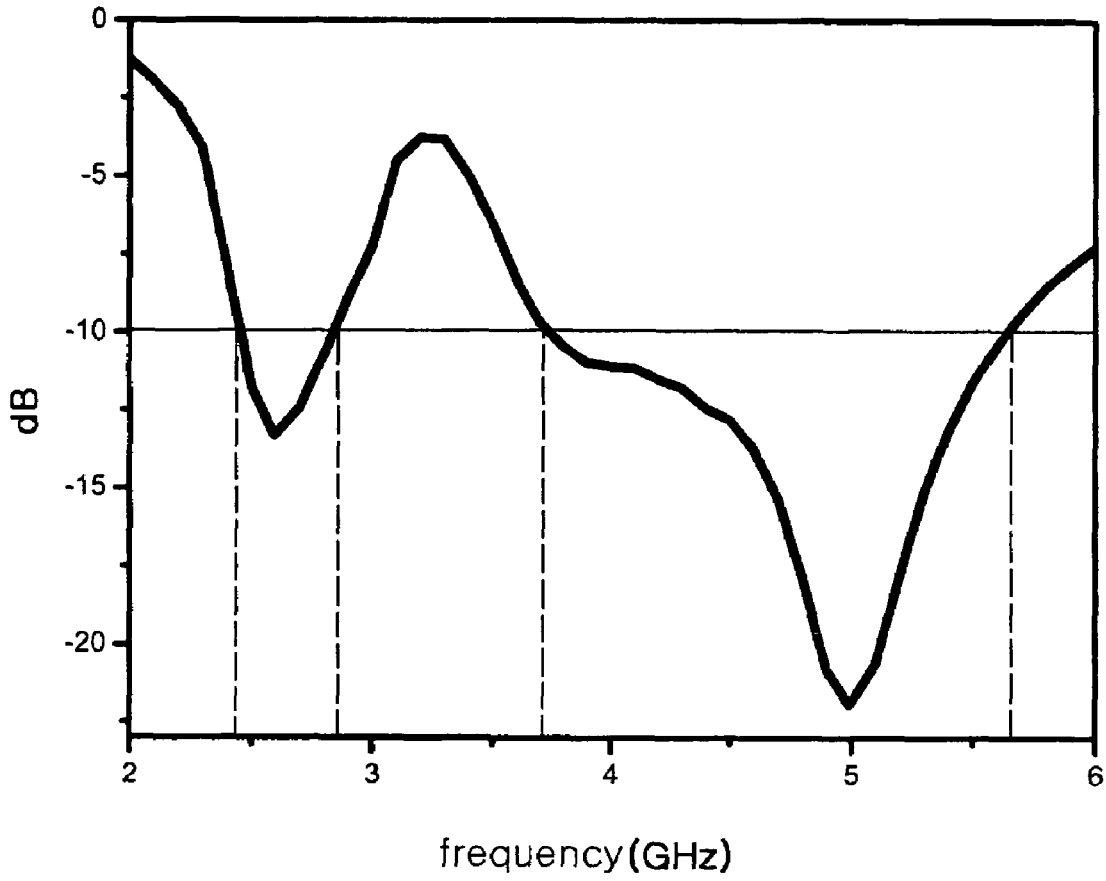
FIG. 8 is a graph illustrating resonance frequency of the chip antenna according to the preferred embodiment of the present invention.

FIG. 8 is a graph showing the resonance frequency of the chip antenna shown in FIG. 7.

Referring to FIG. 8, it can be confirmed that the chip antenna achieves a wide resonance frequency band across the WLAN band and the Bluetooth band. The resonance frequency generally has an attenuation amount of −10 dB or less, and thus it is noticeable that the resonance frequency of the WLAN band was widened from about 2.4 to about 2.8 GHz, and the resonance frequency of the Bluetooth band was widened from about 3.7 to about 5.65 GHz. In addition, stable maintenance of sending and receiving function, which may be undermined by external influences, is expected from such broadband effects.

Figure 1:
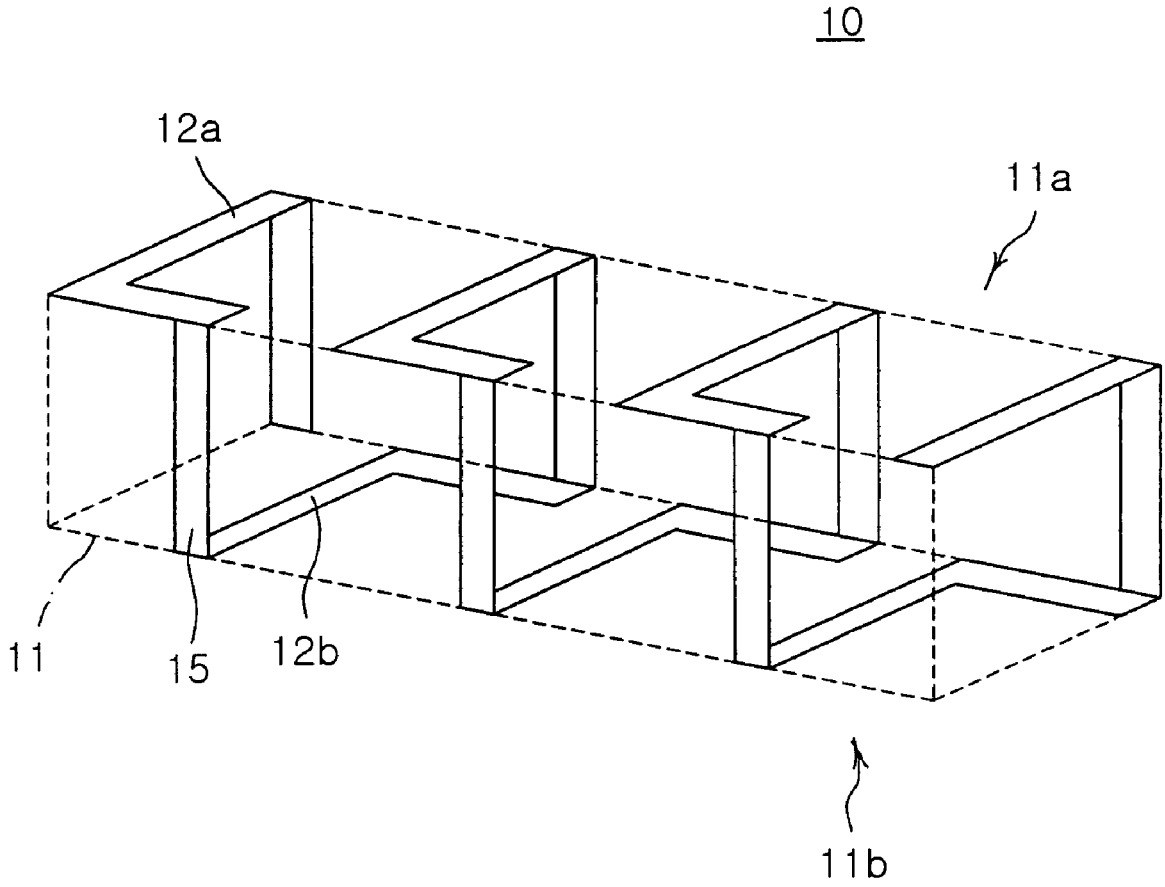
PRIOR ART FIG. 1
FIG. 1 is a perspective view illustrating a conventional chip antenna.

This embodiment has been explained by an example combining the multi-resonance conductor patterns with the embodiment shown in FIG. 3, but the multi-resonance conductor patterns can also be applied to the structure illustrated in FIG. 1, allowing dual resonance or broadband effects.

The present invention set forth above allows formation of a radiation line providing electric resonance length increased from the conventional chip antenna in a same volume. Therefore, even lower resonance frequency can be achieved or the same level of resonance frequency can be achieved in a further miniaturized chip antenna, according to the present invention.

According to another aspect of the invention, the chip antenna can ensure superior sending and receiving function in the changing environment by widening resonance frequency while maintaining a miniaturized structure.

While the present invention has been shown and described in connection with the preferred embodiments, it will be apparent to those skilled in the art that modifications and variations can be made without departing from the spirit and scope of the invention as defined by the appended claims.

What is claimed is:

1. A chip antenna comprising:

a dielectric block having a rectangular parallelepiped structure having a longitudinal direction, a width direction and a vertical direction;

a plurality of first conductor patterns formed on an upper surface of the dielectric block in the width direction;

a plurality of second conductor patterns formed on a lower surface of the dielectric block in the width direction; and a plurality of first conductive vertical connecting parts formed in the vertical direction of the dielectric block to connect the first conductor patterns with the second conductor patterns so that the first and second conductor patterns form a radiation line, wherein each of the first and second conductor patterns comprises at least one pair of L-shaped conductor patterns and at least one horizontal-connecting conductor pattern formed in the width direction, the pair of L-shaped conductor patterns being disposed symmetrically with respect to the center of an area formed by the pair of L-shaped conductor patterns, each L-shaped conductor pattern including a first part disposed in the width direction and a bent part extended from one end of the first part in the longitudinal direction, the bent parts of the pair of L-shaped conductor patterns partially overlapping with each other.

2. The chip antenna according to claim 1, wherein the pair of L-shaped conductor patterns alternate with the horizontal-connecting conductor pattern on the upper and lower surfaces of the dielectric block.

3. The chip antenna according to claim 1, wherein each of the bent parts is angled at 90 degrees.

4. The chip antenna according to claim 1, wherein the first conductive vertical-connecting parts are formed along side surfaces of the dielectric block.

5. The chip antenna according to claim 1, wherein each of the first conductive vertical-connecting parts comprises a conductive via pierced through the upper and lower surfaces of the dielectric block.

6. The chip antenna according to claim 1, wherein the length of the overlapped bent parts of the pair of L-shaped conductor patterns is at least the width of the horizontal-connecting conductor patterns and shorter than the length of the bent parts.

7. The chip antenna according to claim 1, wherein the first and second conductor patterns are formed in equal widths.

8. The chip antenna according to claim 7, wherein the length of the overlapped bent parts of the pair of L-shaped conductor patterns is at least the width of the horizontal-connecting conductor patterns and shorter than the length of the bent parts.

9. The chip antenna according to claim 1, further comprising a dielectric layer provided on upper or lower surface of the dielectric block, having a plurality of third conductor patterns formed on upper or lower surfaces thereof and a plurality of second conductive vertical-connecting parts each connecting each of the first or second conductor patterns of the dielectric block with each end of the third conductor patterns.

10. The chip antenna according to claim 9, wherein the dielectric layer has a size of area corresponding to the size of the upper or lower surface of the dielectric block.

11. The chip antenna according to claim 10, wherein the plurality of third conductor patterns are disposed in a width direction of the dielectric layer.

12. The chip antenna according to claim 9, wherein at least one of the second conductive vertical-connecting parts is connected integrally with a corresponding one of the first conductive vertical-connecting parts of the dielectric block.

* * * * *